United States Patent [19]

Bruchas

[11] 4,440,422

[45] Apr. 3, 1984

[54] SECTIONALIZED PAPERBACK BOOK

[76] Inventor: Edward R. Bruchas, 115 Moyna Dr., Hendersonville, Tenn. 37075

[21] Appl. No.: 405,250

[22] Filed: Aug. 4, 1982

[51] Int. Cl.[3] ..... B42B 9/00

[52] U.S. Cl. ..... 281/15 R; 281/17

[58] Field of Search ..... 281/15 R, 16, 17, 18, 281/3 R, 1, 2, 22, 45, 46, 47, 48, 49; 402/4; 283/4; 282/10, 11, 24 R, 24 C

[56] References Cited

U.S. PATENT DOCUMENTS

| | | | |
|---|---|---|---|
| 187,221 | 2/1877 | Deusner, Jr. . | |
| 256,836 | 4/1882 | Hasbrouck . | |
| 1,790,033 | 1/1931 | Voelcker | 282/24 R |
| 1,914,640 | 6/1933 | Keville . | |
| 1,958,058 | 5/1934 | McCleary | 281/17 |

FOREIGN PATENT DOCUMENTS

| | | | |
|---|---|---|---|
| 223701 | 5/1958 | Australia | 281/17 |
| 452477 | 3/1968 | Switzerland | 281/17 |

*Primary Examiner*—Paul A. Bell
*Assistant Examiner*—John S. Brown
*Attorney, Agent, or Firm*—Buell, Blenko, Ziesenheim & Beck

[57] ABSTRACT

A paperback book has divider pages positioned at intervals between the pages of reading matter and perforations along its spine at such divider pages so that the book can be separated into one or more sections by tearing the spine along a perforation.

6 Claims, 4 Drawing Figures

SECTIONALIZED PAPERBACK BOOK

This invention relates to paperback books. It is more particularly concerned with such books which have so many pages that their thickness makes them difficult to read without breaking their backs.

BACKGROUND OF THE INVENTION

Paperback books, because of their construction, are somewhat fragile. If they are opened wide the pages tend to separate from the spine to which they are attached by adhesive, and this tendency becomes more pronounced the thicker the book. Many novels and other books now published in paperback run to five or six hundred pages or more and are difficult to read comfortably without bending the spine to the extent that loosens their pages.

THE INVENTOR'S SOLUTION TO THE PROBLEM

I have invented a paperback book construction which obviates the difficulties above mentioned without greatly increasing the cost of the book. Books of my construction are bound up with divider pages positioned at intervals between the pages of reading matter, such intervals generally corresponding to divisions between chapters or groups of chapters. The divider pages are made of paper which is stiffer than the pages of reading matter and preferably of stiffness comparable to the front and back covers. The spine of the book to which all pages are attached is longitudinally perforated at such divider pages so that the book can be separated along those perforations into parts, each with its own cover. Preferably the divider pages are doubled between sections so that all sections have front and back covers when they are separated. I also provide a flexible adhesive panel which is applied to the backs of the sections when they are reassembled so as to return the book to its original form.

DESCRIPTION OF PREFERRED EMBODIMENTS

Figure 1:
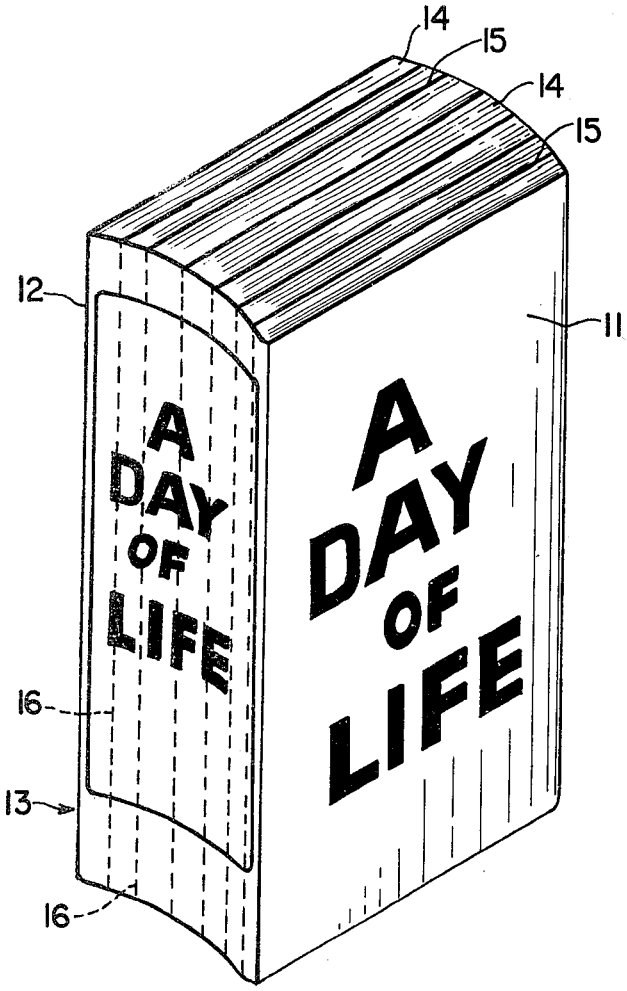
FIG. 1 is an isometric of a book of my invention in an upright position.
Figure 2:
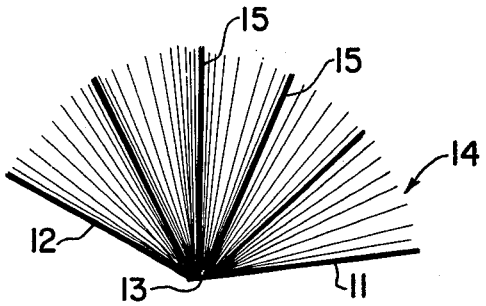
FIG. 2 is a plan of the book of FIG. 1 partially opened.
Figure 3:
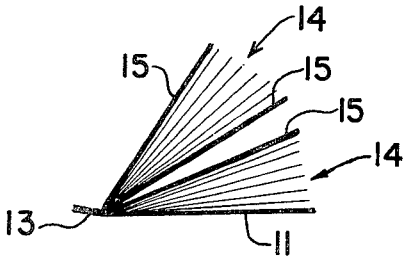
FIG. 3 is a partial plan of another embodiment of a book of my invention partially opened.
Figure 4:
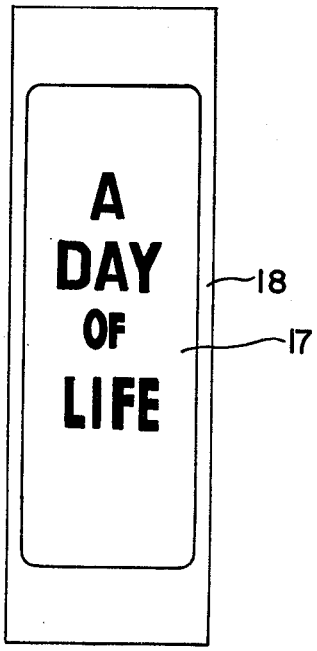
FIG. 4 is an elevation of a label to be applied to the spine of a reassembled book of my invention.

As is shown in the accompanying figures the book of my invention comprises the usual front cover 11, back cover 12 and spine 13, each made of paper. Those elements may be unitary, or separate and joined together. Between those covers and attached to spine 13 are groups 14 of pages of reading matter, each group comprising some portion of the book, such as a chapter or series of chapters having a natural beginning and ending. Between adjoining groups of pages are positioned dividing pages 15. In FIG. 2 a single dividing page 15 separates adjoining sections 14. In the embodiment of FIG. 3, two dividing pages 15 are inserted back-to-back between adjoining sections 14. Dividing pages 15 are preferably of stiffer stock than the pages of reading matter in groups 14 and may be of the same stock as front and back covers 11 and 12. The pages of all groups 14 and all dividing pages 15 are attached at one edge to spine 13, usually by adhesive. Spine 13 is formed with longitudinal perforations 16 at the junctions of dividing pages 15 and spine 13, as is shown in FIG. 1. In the embodiment of FIG. 3 the perforations 16 in spine 13 are positioned between the junctions of adjoining dividing pages 15 and spine 13. My book is intended to be sold together with an adhesive backed panel 17, illustrated in FIG. 4, of shape and area about that of the spine 13 of the assembled volume. That panel may have a removable backing 18 over its adhesive side and may be removably attached to the book, for example, to the inside or back of cover 11 and 12. The panel may carry the title of the book.

A reader of a book of my invention who finds it unhandy may separate one or more sections from the remaining sections by tearing spine 13 along the appropriate perforation 16. When the embodiment of FIG. 3 is so divided, the divided portion or portions and the remaining portions of the book will have stiff covers both front and back. When the embodiment of FIG. 2 is so divided the interior sections will each have only one stiff cover. Perforation 16 may be located at one side or the other of dividing page 15. The book may be reassembled by placing all sections side-by-side in proper order and applying my panel 17 to their spines, thus uniting them again.

I claim:

1. A paperback book comprising a plurality of sections each section comprising a plurality of pages, at least one dividing page between each pair of contiguous sections, said dividing page being stiffer than the pages of the sections, and a spine secured to adjacent edges of all pages so as to bind them together, said spine being longitudinally perforated at each dividing page whereby adjoining sections may be divided by tearing the spine along said perforations.

2. The paperback book of claim 1 in which the spine is paper.

3. The paperback book of claim 1 including front and back paper covers integral with said spine, said covers being stiffer than the pages of the sections.

4. The paperback book of claim 1 including two dividing pages between each pair of contiguous sections, said dividing pages forming front and back covers for a detached section.

5. The paperback book of claim 4 in which the longitudinal perforations are positioned between the two dividing pages.

6. The paperback book of claim 1 or 4 in combination with an adhesively backed panel adapted to be applied to the spine of the reassembled sections of the book to hold those sections together again.

* * * * *